US007686196B2

(12) United States Patent
Panosian et al.

(10) Patent No.: US 7,686,196 B2
(45) **Date of Patent: *Mar. 30, 2010**

(54) RETAINER FOR DETACHABLY ATTACHING AN ACCESSORY TO A UTILITY BELT

(76) Inventors: Michael Panosian, 2425 Canada Blvd., # 102, Glendale, CA (US) 91208; Paulo Kang, 267 N. Holliston, #1, Pasadena, CA (US) 91106; Joshua M. Keeler, 1121 E. Chevy Chase Dr., #1, Glendale, CA (US) 91205; James Kendall Stobar, 946 Blue Mountain Cir., Westlake Village, CA (US) 91362

( * ) Notice: Subject to any disclaimer, the term of this patent is extended or adjusted under 35 U.S.C. 154(b) by 347 days.

This patent is subject to a terminal disclaimer.

(21) Appl. No.: 10/838,601

(22) Filed: May 4, 2004

(65) Prior Publication Data

US 2005/0263552 A1 Dec. 1, 2005

(51) Int. Cl.
*A45F 5/00* (2006.01)

(52) U.S. Cl. ..... 224/269; 224/666; 224/904

(58) Field of Classification Search ..... 224/269, 224/271, 904, 196, 663, 930, 666, 668, 197, 224/272; 206/372, 373

See application file for complete search history.

(56) References Cited

U.S. PATENT DOCUMENTS 4,384,372 A * 5/1983 Rector ..... 2/300
5,038,985 A * 8/1991 Chapin ..... 224/669
5,452,829 A * 9/1995 King et al. ..... 224/666
5,971,242 A * 10/1999 Schuerman ..... 224/544
6,098,858 A * 8/2000 Laugesen ..... 224/197
6,176,401 B1 * 1/2001 Lim ..... 224/196
6,357,641 B1 * 3/2002 Cheng ..... 224/242
6,626,336 B1 * 9/2003 Krusell ..... 224/271
6,848,605 B2 * 2/2005 Dillenberger ..... 224/670
2002/0170933 A1 * 11/2002 Martin ..... 224/197
2003/0029976 A1 * 2/2003 Saitoh et al. ..... 248/226.11
2003/0141329 A1 * 7/2003 Huang ..... 224/197
2009/0145789 A1 * 6/2009 Panosian et al. ..... 206/373
2009/0145866 A1 * 6/2009 Panosian et al. ..... 211/85.15

* cited by examiner

*Primary Examiner*—Nathan J Newhouse
*Assistant Examiner*—Justin M Larson
(74) *Attorney, Agent, or Firm*—Lackenbach Siegel LLP; Myron Greenspan

(57) ABSTRACT

A carrying clip for detachably connecting an accessory to a tool belt in the form of an elongate flexible strap defining an upper edge includes a gripping portion configured to be gripped by the fingers of a user and positioned in proximity, and positioned in proximity to the straps upper edge. The gripping portion is associated with and supports an accessory to be detachably connected to the strap. An attachment member, which may be in the form of a spring-clip or a snap-lock clip arrangement, is used for detachably connecting the gripping portion to the strap and for removing the gripping portion and associated accessory by engagement of the gripping portion with the finger of the user and lifting the gripping portion in a general upward direction relative to the strap.

15 Claims, 7 Drawing Sheets

RETAINER FOR DETACHABLY ATTACHING AN ACCESSORY TO A UTILITY BELT

BACKGROUND OF THE INVENTION

1. Field of the Invention

The invention generally relates to a utility belt system and, more specifically, to an ergonomic convenient-to-use retainer for detachably attaching an accessory to a modular/customizable utility belt.

2. Description of the Prior Art

Tool bags and/or belt-supported pouches for carrying nails, screws, bolts and other tools are well known in the industry. Typically, a "tool belt" is a belt having a number of pouches and/or tool holders fixedly or permanently attached to the belt. However, since no two people are alike or perform their tasks in the same way, the preferred locations, sizes and shapes of the pouches and tool holders vary according to the tradesperson and the task at hand. Accordingly, there is a need for a tool belt that can be easily modified to suit the individual and the task at hand.

Numerous tool bags and tool belts have been proposed that have removable or interchangeable pouches or tool holders. However, these tool bags have offered a limited range of adjustability, and the pouches and tool holders can be easily knocked off of the belt, causing nails, screws, bolts and/or tools to fall and possibly scatter. This is especially dangerous when a person is working at a higher level and other people are below him or her.

The known tool belts have also exhibited disadvantages in the ways in which pouches or object-receiving receptacles are added, removed or interchanged. As suggested, such receptacles have typically been permanently attached to the tool belts. When removable, these items have been inconvenient, difficult or awkward to attach or detach from the tool belt, especially when the pouches or receptacles are large, bulky or heavy. With most tool belts, pouches are provided with loops through which the belts can be threaded. With such tool belts, pouches or receptacles can be removed only by opening the belt and sliding all the pouches off one or the other end of the belt. Examples of such tool belts are described in U.S. Design Pat. No. D302,489 and U.S. Pat. No. 4,923,105. Other patents disclose the use of various fasteners, such as snaps, hook and loop tape (e.g., "VELCRO") and the like. These fasteners frequently make it difficult, if not impossible, to detach the pouch, especially if one has to do this with one hand while the other hand is occupied. The fasteners are typically behind the pouches, which means that they must be released or forcibly separated or pulled apart, with the user's force moving in a direction substantially away from the user. And most tool belts are not intended to facilitate the attachment, detachment or interchange of pouches in the context of difficult or complicated conditions, such as while climbing a ladder, stretched out under a car, crouched in a tight space, etc.

SUMMARY OF THE INVENTION

Accordingly, is an object of the invention to provide a utility belt system that overcomes the disadvantages of prior art tool belts.

It is another object of the invention to provide an accessory retainer for a utility belt system that is simple in construction and economical to manufacture.

It is still another object of the invention to provide an accessory retainer for a utility belt system that is easy and convenient to use.

It is yet another object of the invention to provide a retainer for a utility belt system, one that is modular and can be highly customized to the preferences of the user.

It is still another object of the invention to provide a retainer for a utility belt system which can be conveniently used by allowing the user to quickly and easily release a pouch or receptacle with the fingers of the user for lifting the same off of the tool belt.

It is a further object of the invention to provide a retainer for a utility belt system that allows the pouches or receptacles supported thereby to be easily and conveniently separated and lifted off of the tool belt.

It is still a further object of the invention to provide a retainer clip for a utility belt system in accordance with the previous objects, one that allows a user to add, remove or interchange pouches or object-receptacles with ease and convenience substantially independently of the sizes, shapes or weights of such pouches or receptacles.

In order to achieve the above objects and others that will become evident to those skilled in the art, a retainer is provided for detachably connecting an accessory to a tool belt in the form of an elongate flexible strap defining an upper edge when the strap is worn by a user. The retainer comprises a gripping portion configured to be gripped by the fingers of a user and positioned in proximity to the strap's upper edge when supported on the strap. The gripping portion is associated with, or forms part of, and supports an accessory to be detachably connected to the strap. Attachment means is provided for detachably connecting said gripping portion to the strap and for removing said gripping portion and associated accessory from the strap by engagement of said gripping portion by the fingers of the user and lifting said gripping portion in a generally upward direction relative to the strap. According to one feature of the invention, said attachment means may include a locking means for selectively locking said gripping portion to said attaching means and to the strap, and releasing means in proximity of said gripping portion being provided for selectively releasing the locking engagement of said locking means by activation by the user's finger of said releasing means substantially contemporaneously while lifting the accessory by means of said gripping portion.

BRIEF DESCRIPTION OF THE DRAWINGS

The features of the present invention are disclosed in the detailed description and in the drawings, in which.

DESCRIPTION OF PREFERRED EMBODIMENTS

Figure 1:
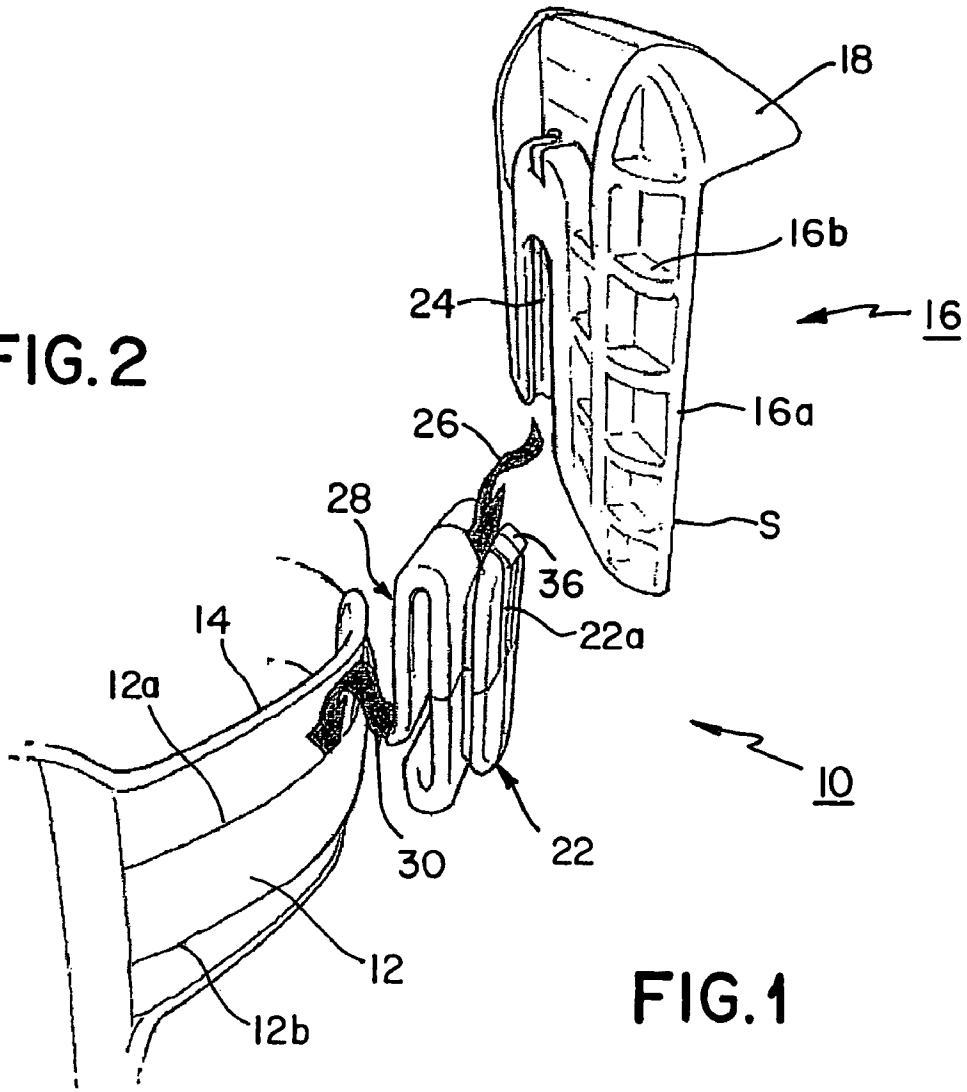
FIG. 1 is a perspective exploded view of a retainer in accordance with the invention, illustrating an embodiment that can lock an accessory such as an object-receiving pouch or -receptacle to a strap of a tool or utility belt.

Referring now for the Figures, in which similar or identical parts are identified by the same reference numerals throughout, and first referring to FIG. 1, a belt utility system in accordance with the present invention is generally designated by the reference numeral 10.

Figure 2:
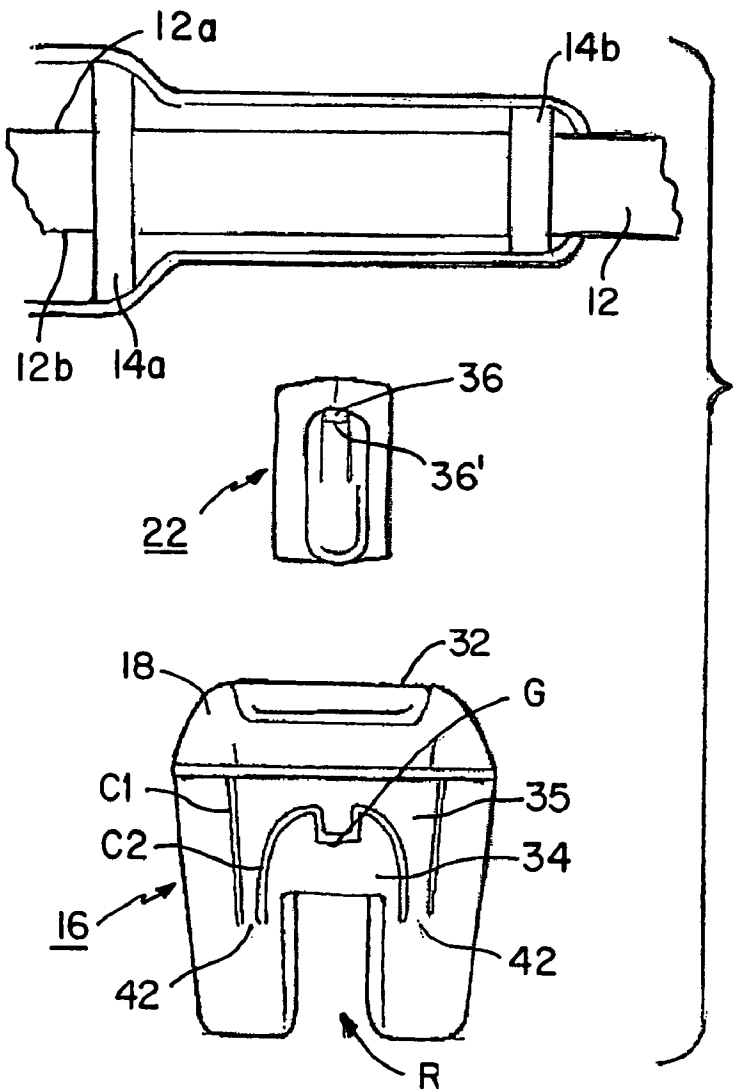
FIG. 2 is an exploded front elevational view of the retainer system shown in FIG. 1, including the portion secured to a pouch or other accessory and a clip for selectively attaching and detaching the retainer to the strap of the utility belt.

The belt utility system 10 includes a generally flexible flat belt or strap 12 provided with an upper edge 12*a* and a lower edge 12*b*. Referring also to FIG. 2, a back brace 14 may be secured to the strap 12 by means of generally vertical strips 14*a*, 14*b* which loop over the strap. An important feature of the present invention is the provision of a retainer clip, shown in FIGS. 1 and 2, for selectively detaching or attaching an accessory to a user's tool belt. The accessory can be in the form of a pouch or other receptacle for articles, supplies or tools.

Referring to FIG. 1, the retainer system 10 contains a support body 16 that generally includes a flat support panel 16*a* that defines on a front support surface S to which a pouch, receptacle or other accessory (not shown) may be mounted or connected. The reverse side of the support panel may be provided with reinforcing ribs 16*b* to stiffen the support panel.

An important feature of the invention is the provision of a gripping portion 18 formed at the top of the support body 16, which is configured to be gripped by the fingers of a user. While the specific shape or configuration of the gripping portion 18 is not critical, the gripping portion preferably includes at least a portion that extends in a direction opposite to the direction of the rear side of the support body 16 on which the ribs 16*b* are provided. In this way, the gripping portion can be easily and conveniently gripped by the fingers of the user when the support body 16 is attached to or separated from the belt or strap 12.

The support body 16 may be attached to the strap 12 in a number of different ways. Thus, the support body 16 may be simply removably engaged to the strap 12 without a locking mechanism that would prevent inadvertent separation of the support body from the belt, or with a locking mechanism ensures that the support body 16 can only separate from the belt 12 when the user takes a positive action to release the support body.

In FIGS. 1-11, details are shown of one presently preferred embodiment of the invention in which the support body 16 is selectively detachably supported on the strap 12 of the utility belt by means of a snap-lock connector. It will be understood by those skilled in the art that numerous other designs may be used to achieve the same or similar functions.

Figure 11:
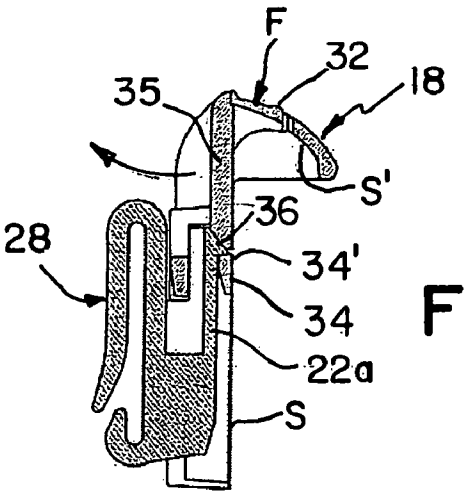
FIG. 11 is a side elevational cross-sectional view of the assembly shown in FIG. 6, taken along Line 11-11.
Figure 6:
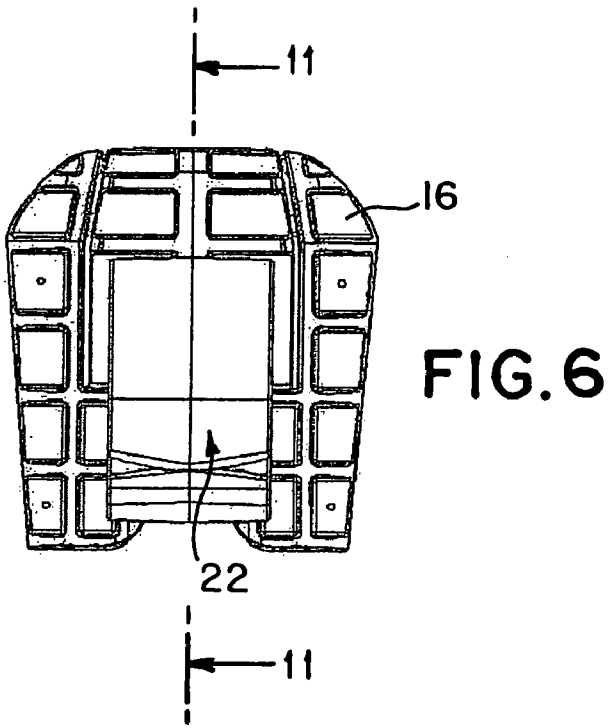
FIG. 6 is a rear elevational view of the assembly shown in FIGS. 3-5.
Figure 5:
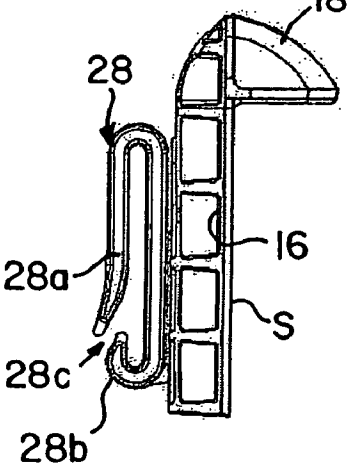
FIG. 5 is a side elevational view of the assembly shown in FIGS. 3 and 4.
Figure 3:
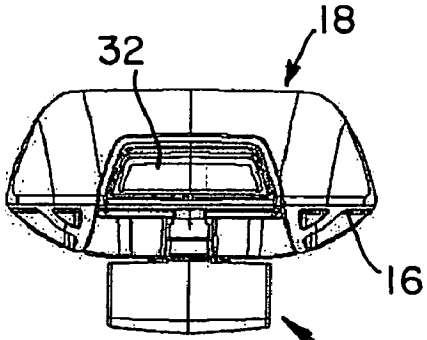
FIG. 3 is a top plan view of the assembly shown in FIG. 2.
Figure 8:
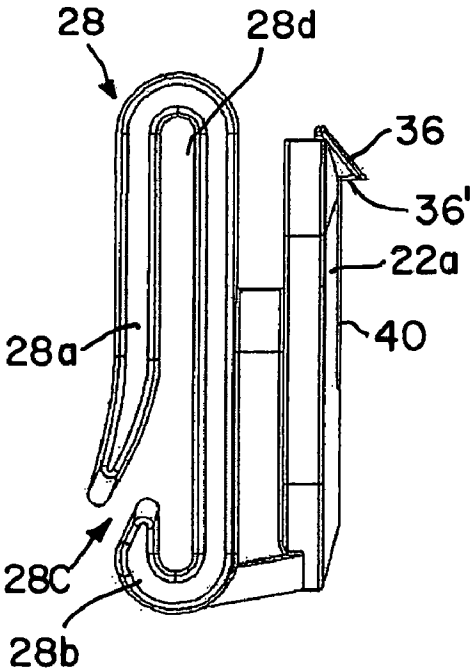
FIG. 8 is a side elevational view of the detent shown in FIG. 7.

The clip system 10 includes, in addition to the support body 16, a mole snap-lock member hook 22, the details of which are best shown in FIGS. 5, 8 and 11. Thus, the member 22 includes an upwardly projecting resilient snap-lock finger 22*a* provided with a tapered hook 36 portion having a detent or bearing surface 36'. The configuration and dimensions of the snap-lock member 22 are selected to be received within a female snap-lock channel 24 at the rear of the support body 16. The panel 16*a* is provided with cut-outs C1, C2 to provide a relatively rigid or stationary panel portion 34, and an upper, movable panel portion 35 that flexes about connection points 42, so that the panel portion 35 can flex about the connection points 42 relative to the plane of the panel portion 34. The cut-out C2 defines a gap G at the center of the clip that is dimensioned to receive the tapered hook 36. Integrally connected with the member 22 is a rearwardly projecting strap attachment element 28, which includes a downwardly extending finger 28*a* that tapers outwardly or rearwardly at the bottom thereof, as shown in FIG. 8, and a hook 28*b*, together forming an opening or passageway 28*c* dimensioned to receive the strap 12. The finger 28*a* and the hook 28*b* are tapered and configured to facilitate the insertion of the strap 12 into an internal space 28*d* by a generally downward movement 30 as suggested in FIG. 1, which causes the upper edge of the strap 12 to initially engage the tapered lowered end of the finger 28*a* to guide the strap into the space 28*d*. Once the strap is fully seated within the space 28*d*, the lower edge of the strap engages the hook 28*b*, and this prevents inadvertent separation of the attachment element and the strap.

Similarly, the support body 16 can be lockingly engaged with the snap-lock member 22 by aligning the channel 24 with the resilient finger 72*a* and lowering the support body 16 in a generally downward motion, as suggested by the arrow 26 in FIG. 1. The channel 24 is dimensioned to initially urge the finger 22*a* rearwardly until the finger is fully seated within the channel 24, at which time the hook end of the finger is received within the gap G to engage the detent surface 36' with the locking surface 34' of the fixed or stationary panel portion 34. This is best illustrated in FIG. 11, which shows the spring or resilient finger 22*a* fully seated within the channel 24.

An important feature of the invention is to provide a release element or button that is conveniently positioned to unlock or release the snap-lock resilient finger from the locked position shown in FIG. 11 to allow a user to lift the support body 16 from the member 22. For this purpose, there is provided a release tab or button 32 conveniently located at the top of the gripping portion 18 for selectively disengaging the snap-lock mechanism when actuated by the finger of a user. Referring to FIG. 11, for example, application of a force F to the button or tab 32 causes the panel portion 35 to move it rearwardly and, by doing so, to force the tapered hook element 36 out of contact with the detent surface 34 of the member 34. As soon as the elements 36 and 34' have been shifted so as not to engage with one another, the supporting body 16 may be raised relative to the attachment of the clip element that remains attached to the strap 12. In this way, the snap-lock mechanism may be disengaged substantially contemporaneously by a user just prior to lifting and separating an accessory from the strap.

In the illustrated embodiment, a gripping portion 18 extends in a direction generally away from the direction of the strap, when worn by the user, to facilitate gripping by the fingers of the user, whether the accessory is mounted on the front of the user or in the back of the user. As best shown, for example, in FIGS. 5 and 11, the gripping portion 18 preferably defines a finger-engaging surface S' that is generally downwardly concave so that when the user grips the portion 18 and inserts his or her fingertips underneath this portion, this minimizes the risk of slippage of the fingers of the user, while supporting and handling the accessory, pouch or receptacle attached to the supporting body 16.

While the spring finger 22*a* is received behind the substantially fixed panel portion 34, the rest of the clip 22 is received within recess R (FIG. 2).

Figure 4:
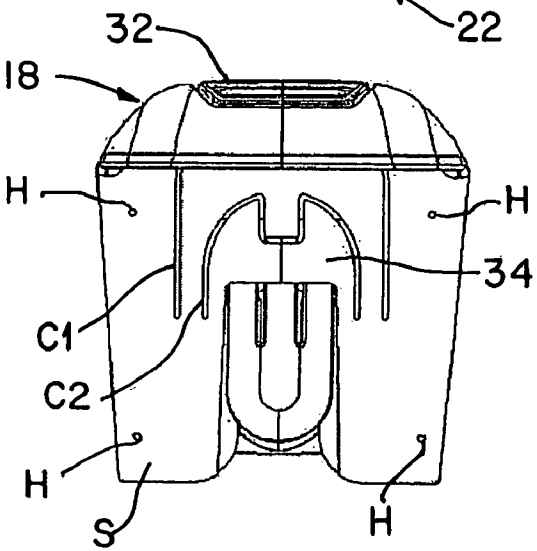
FIG. 4 is a front elevational view of the assembly shown in FIG. 3.
Figure 9:
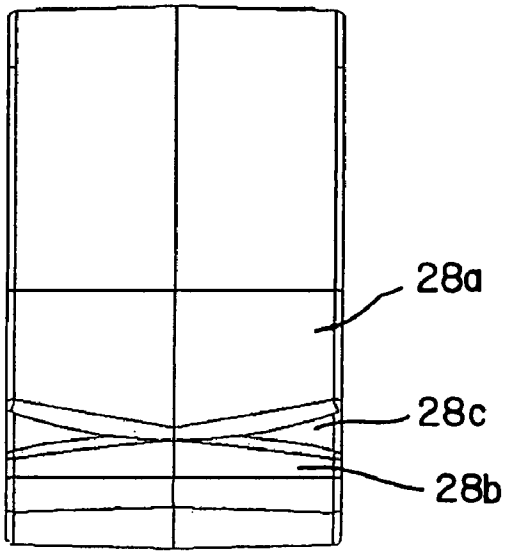
FIG. 9 is a rear elevational view of the detent shown in FIGS. 7 and 8.
Figure 10:
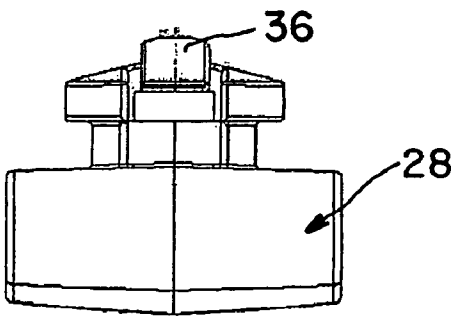
FIG. 10 is a top plan view of the detent shown in FIGS. 7-9.
Figure 7:
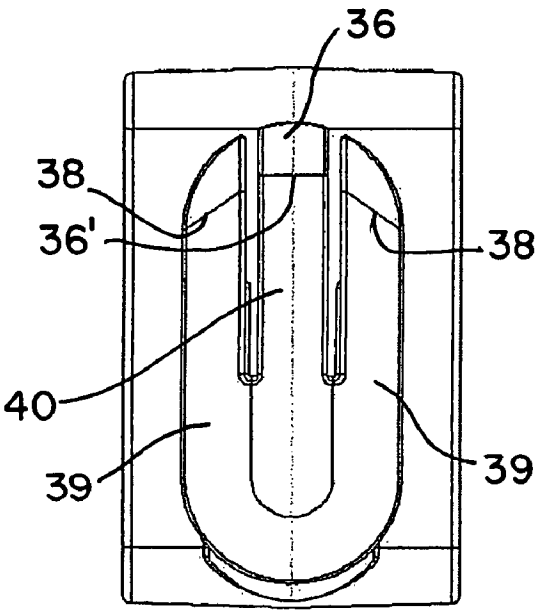
FIG. 7 is an enlarged front elevational view of the snap-lock detent or catch shown in FIGS. 1-6.
Figure 12:
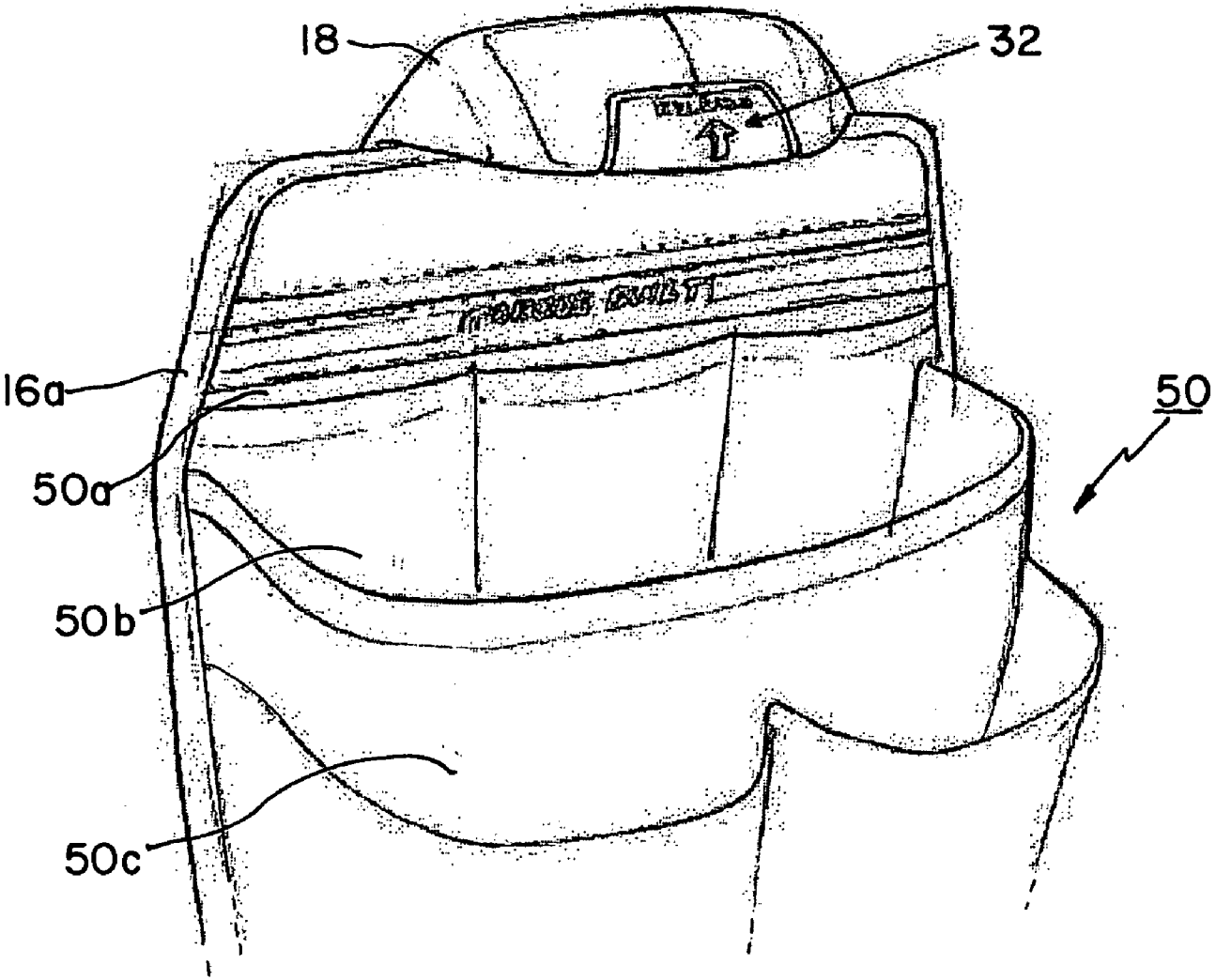
FIG. 12 is a perspective view of an object-receiving pouch or receptacle attached to the retainer system of the present invention, illustrating a release button for disengaging the pouch from the clip attached to the belt.
Figure 13:
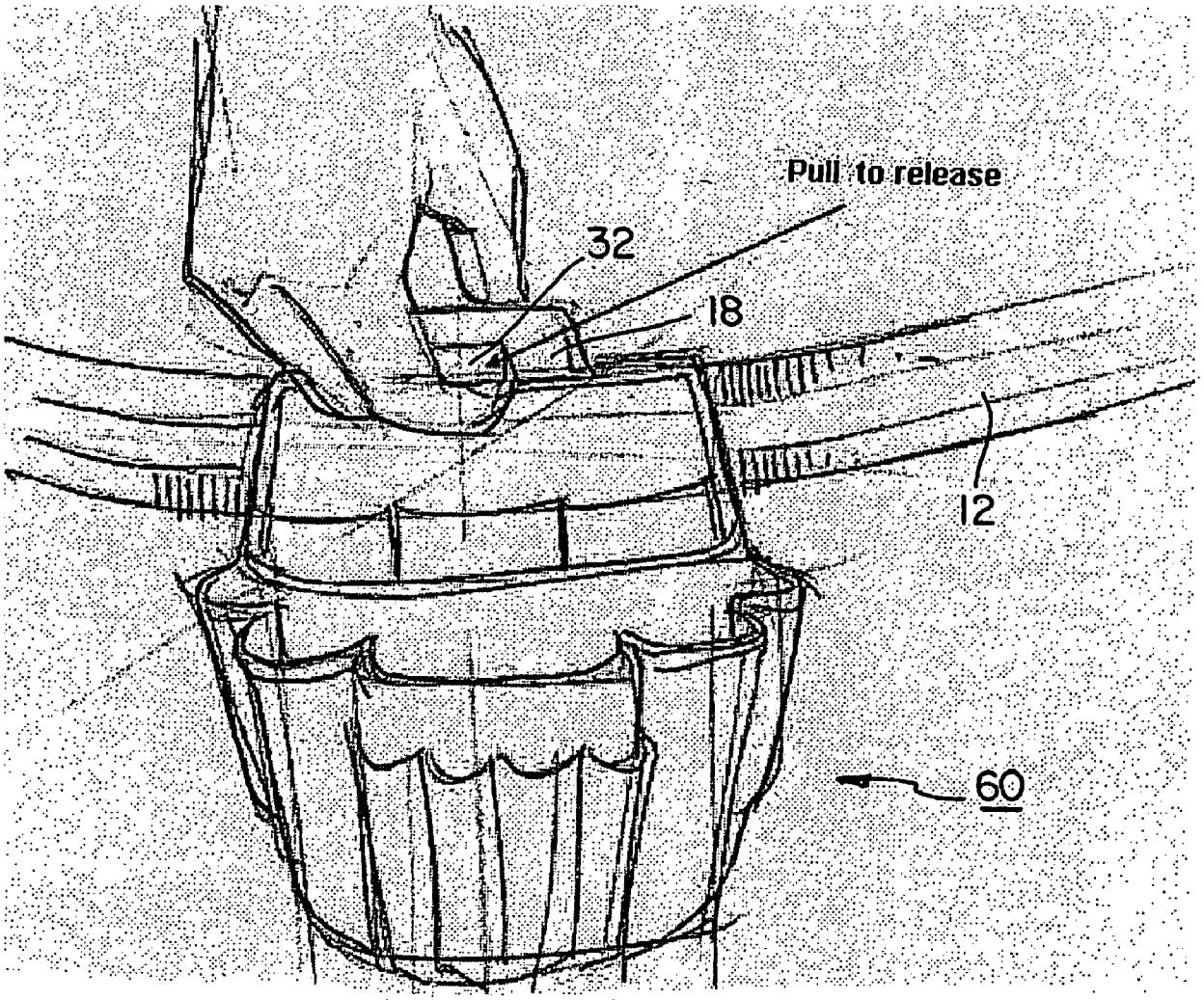
FIG. 13 is similar to FIG. 12, illustrating the manner in which a user can conveniently release a pouch or receptacle of a modular utility belt system by actuating a release button or tab with a finger and lifting the pouch or receptacle from the belt.

Referring to FIG. 7, optional detent surfaces 38 may be provided on additional lateral fingers 39 that can also be received within adjacent portions of the opening of the cutout C2 adjacent to the gap G. Referring to FIG. 4, holes H can be provided on the front surface S of the support panel 16*a* that can be used to secure various soft pouches or receptacles, such as the pouch 50 shown in FIG. 12. Once the pouch 50 is mounted on the support panel 16*a,* the gripping portion 18 remains exposed and very accessible at the top of the unit, as is the release button 32. Any pouch or receptacle may be used, the pouch 50 shown including rear pockets 50*a,* an intermediate receiving compartment 50*b* and front pockets 50*c*. However, regardless of the size, shape or weight of the actual pouch or receptacle, the gripping portion 18 and the release button always remain available to be gripped by the fingers of the user and attached or detached to the strap 12. This is additionally illustrated in FIG. 13, in which a different style pouch or receptacle 60 is shown being separated or removed from the belt 12, showing the natural and ergonomic positions of the fingers of the user in gripping the gripping portion 18, the thumb being position behind such gripping portion, and one or more of the user's fingers being placed underneath the gripping portion through the front end thereof. The same position of the fingers, allowing the pouch to be gripped and removed, can also be used to release the button or tab 32 to unlock the pouch from the belt by disengaging the snap-lock mechanism, as suggested above.

As indicated, numerous snap-lock designs may be used to achieve the objects of the present invention. However, regardless of the specific design used, each of the designs in accordance with the present invention provides the same facility, convenience and ease of use. Attaching a pouch, receptacle or other accessory to a tool or utility belt, removing or separating it from that belt, or sharing such items among users is made significantly easier. In each case, the user can access and easily grip the pouch, receptacle or accessory, regardless of whether it is positioned in front or in back on his or her belt, as long as he or she can place the fingers on the easily accessible gripping portion 18 at the top of such units.

Figure 14:
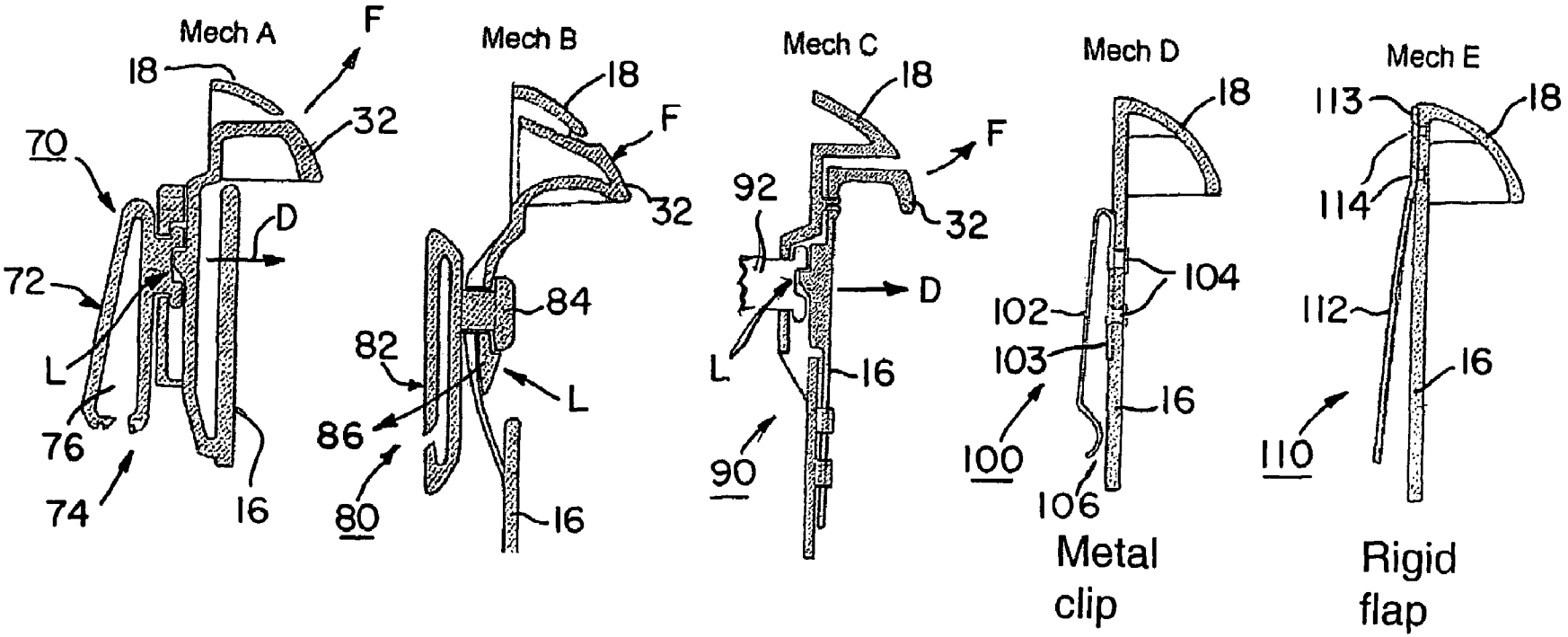
FIG. 14 shows side elevational cross-sections, similar to FIG. 11, showing alternate retainer mechanisms that can be used with the present invention: the first three mechanisms, A-C, include snap-locking mechanisms, while the remaining two mechanisms D and E are non-locking mechanisms.

In FIG. 14, the mechanisms A-C illustrate snap-lock arrangements, while two simple arrangements are shown as mechanisms D and E that do not use locking arrangements. The illustrated examples of the three snap-lock arrangements include mechanisms A-C. Mechanism A includes a belt retaining member 72, including a self-locking detent 74 that can be snapped and locked after the strap has been received within the space 76. A snap-lock arrangement L is provided, a portion of which is formed on the unit 72, which another portion is connected to the support body 16 and the gripping portion 18. The lock release button or tab 32 is arranged so that application of a pulling force F caused the detent 78 to be withdrawn from within a channel into which it is resiliently forced, allowing the gripping portion and support body 16 to be lifted and separated from the belt clip 72.

Mechanism B includes a snap-lock arrangement 80, which includes a belt-retention member 82, similar to the one shown in FIG. 11. Connected to the belt clip 82 is a first snap-lock element 84. The second snap-lock element 86 is engaged in locking position, as shown in FIG. 14. By pressing on the button or tab 32 in the manner suggested by the force F, the detent 86 is moved away the other snap-lock element and the two can be separated by lifting the gripping portion 18.

Mechanism C includes a post 92 that forms part of the snap-lock arrangement L and is attached to the belt or strap. A pulling force on the tab or button 32 causes the detent to move out of the shown slot or groove, which is formed in the post 92, allowing the panel to be lifted when an upward-pulling force is applied to the gripping portion.

It will appreciated that in each of the examples shown, mechanisms A-C, all have a tab or release button 32 in close proximity to the gripping portion 18, so that placement of a user's fingers on the gripping portion also allows simultaneous application of a force on the tab or release button 32 by one or more fingers to release a snap-lock arrangement. Once such release has been effected, the user's fingers can pull, generally upwardly, to separate the support body 16 and any pouch or receptacle mounted thereon, from that portion of the clip arrangement that remains attached to the belt.

While it is an advantage in the use of a snap-lock arrangement, as described above, so that the pouch or receptacle cannot be inadvertently separated from the tool belt or strap, there may be instances in which simpler constructions can be used where a locking feature may not be necessary or essential. Other considerations, such as financial ones, may dictate a simpler construction. In FIG. 14, mechanisms D and E illustrate examples of such simpler mechanisms that, nevertheless, provide important features of the invention—namely, the non-locking versions still provide universal accessibility, to the user's fingers, to a pouch or accessory mounted on the belt regardless of whether the item is mounted on the front or at the back of the user. The gripping portion 18, which in all instances is generally mounted along or above the upper edge 12*a* of the strap 12, can be used to attach, separate or exchange pouches or receptacles or accessories with other users, regardless of the size, shape or weight of the items. All receptacles can be gripped and conveniently handled by simply gripping the gripping portion 18 that conveniently projects upwards and above the item to be handled.

Figure 16:
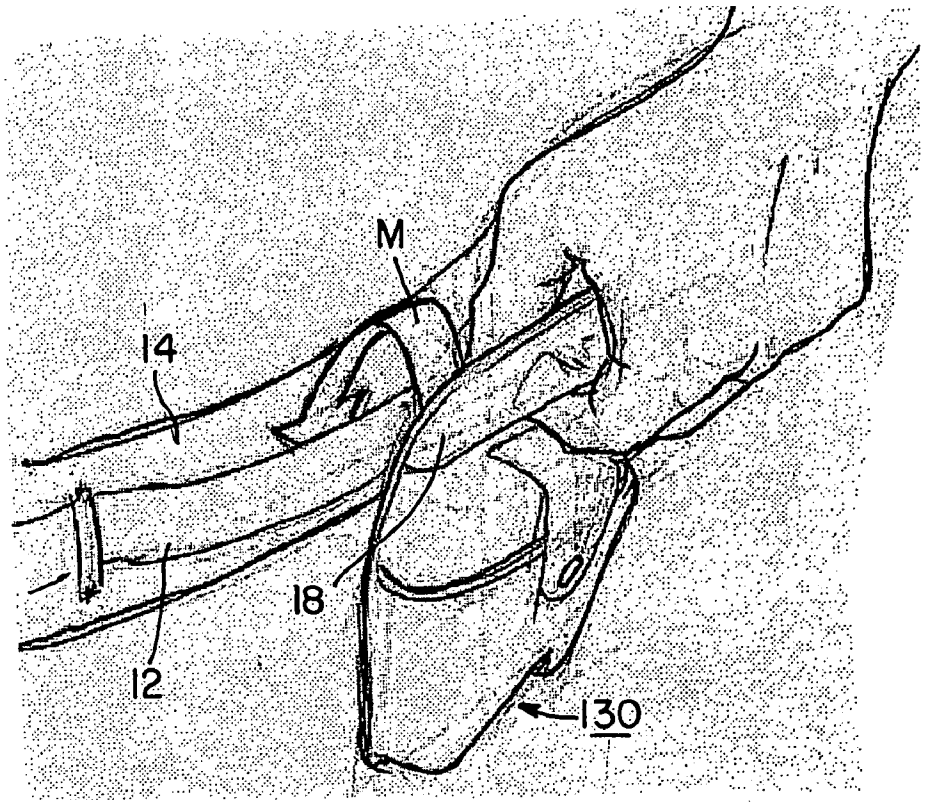
FIG. 16 illustrates the manner in which the spring clip shown in FIG. 15 can be mounted on the strap of a tool belt.
Figure 15:
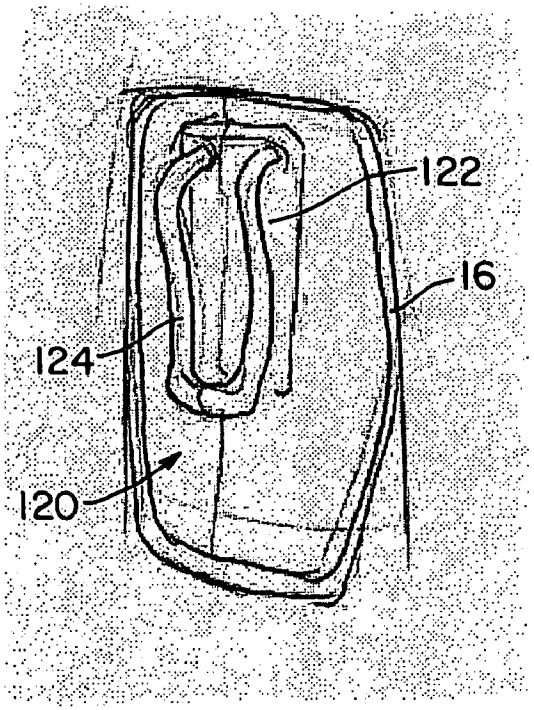
FIG. 15 is a rear perspective view of an alternate spring clip design.

Mechanism D illustrates a simple clip arrangement 100 having a spring clip 102 folded over on itself and having a front leg 103 attached in any suitable way to support body 16 by means of, for examples, rivets 104. The lower end of the free leg may be curved rearwardly as shown to facilitate slipping over a strap of the tool belt. As with the other embodiments, the gripping portion 18 is situated at the upper end of the support body 16. The same is true for mechanism B, in which a simple clip 110 is shown in which a rigid flap 112 has an upper portion 113 thereof fixedly attached to the support body 16 by means of rivets or other fasteners 114, and the lower, depending finger being inclined outwardly as shown to facilitate insertion of a strap or belt under the flap 112. Except for the locking feature, mechanisms D and B function in ways similar to mechanism A-C except that the former do not have an additional button or snap 42 for releasing a snap-lock mechanism. Accordingly, referring to FIGS. 15 and 16, a pouch or receptacle 130 can be simply slipped onto a belt or strap 12 by lowering the pouch along a direction M to engage the strap 12 underneath the spring clip 124, which is shown to be rigidly mounted on a plate 122, itself mounted on the support body 16 to which the pouch or receptacle is secured.

It will be evident to those skilled in the art that while the retainer system described above utilizes a separate support body 16, to which a soft or flexible pouch is secured in any suitable way, such as fasteners, through holes H (FIG. 4), a separate support body 16 is not essential, and such body may itself form part of the pouch, receptacle or accessory. Thus, in such an instance, the gripping portion 18 may be permanently attached or integrally formed with a portion of the pouch, receptacle or accessory. Clearly, it makes no difference whether the pouch, receptacle or accessory is secured to a support body 16 in order to provide a secure connection to the finger portion 18, or whether the finger protection 18 is integrally formed with the unit to be handled.

It will be clear that the utility belt system 10 of the present invention is designed to make the daily tasks of carrying and using tools and other supplies easy, fast and customizable to individual needs. The system allows the user to organize the apparatus to suit his or her own preference—secured to the belt by means of a snap lock and provided with a finger-gripping portion that includes a quick-release mechanism, tools and supplies of the user's own choice can be detached, attached, organized, shared and transported—as many or as few as desired. Each user, therefore, can construct the invention in his or her own way. In short, this system gives the end-user the freedom to accomplish tasks as he or she wants to do so. It allows users to create systems to support their daily routines in an efficient and convenient way.

Existing tool belts in the marketplace provide a very limited choice of arrangements and accessories. The utility belt system of the present invention provides a wide range of advantages over these tool belts: the present invention accommodates the needs of tradespeople in different fields of hand work, such as framing, carpentry, plumbing, electrical, finishing, auto mechanics and many others.

The unique finger-gripping portions that form part of the carry clip allow the user to lighten a load by taking off pouches when these are not essential or when the user has to crawl or climb. And sometimes it is necessary to share tools or supplies. With the present invention, this is easily achieved: a given pouch or receptacle can simply be taken off and handed to a colleague without undoing a belt and without regard to whether the pouch is in front or at the back of the user. Simply by lifting the finger-gripping portion the pouch can be separated from the belt. When a snap-lock arrangement forms part of the carry clip, the user can conveniently and easily apply pressure to an ergonomically positioned snap-releasing tab or button and simultaneously unlock the pouch and lift and separate it from the belt. This is extremely convenient as the user can perform these functions manually in just one single step. This ergonomic unlocking motion is a natural and easy one.

The belt can be configured to retailers' customer base and their selling strategy. The target uses for this product are do-it-yourself (DIY), handyman, finishers, professional contractors, electricians, plumbers, craftsmen and many other tradesmen.

While this invention has been described in detail with particular reference to preferred embodiments thereof, it will be understood that variations and modifications will be effected within the spirit and scope of the invention as described herein and as defined in the appended claims.

What is claimed:

1. A support clip for detachably connecting an object to a support member, the clip comprising a support body having a rear surface facing a support member when the clip is supported on the support member and a front surface facing in an opposing direction away from the support member when the clip is supported on the support member;

attaching means for attaching an object to said front surface of said support body;

a finger grip that is connected to and extends in a direction away from said support member when the clip is supported on the support member, at least a portion of said finger grip always being situated above and defining a generally downwardly facing gripping surface spaced from an attached object to provide a space between said finger grip and the supported object for a user to insert at least one finger between said gripping surface and the object, said finger grip being secured to said support body at a position proximal to said support body and said finger grip extending outwardly in cantilever fashion to a distal position relative to said support body to render the remainder of said periphery accessible for positioning a user's fingers below said finger grip;

and connecting means for detachably locking said support body and attached object to and from the support member, said connecting means including an actuating member mounted within said finger grip and positioned to enable the fingers of a single hand to simultaneously engage both said gripping surface and said actuating member, whereby placement of a user's fingers of one hand under said gripping surface while contemporaneously actuating said actuating member with the same hand permits lifting said finger grip in a generally upward direction relative to the support member.

2. A support clip as defined in claim 1, wherein said finger grip defines a finger-engaging surface that is generally downwardly concave to minimize the risk of slippage of the fingers of the user while supporting and handling of the object.

3. A support clip as defined in claim 1, wherein said connecting means includes locking means for selectively locking said support body to the support member, and releasing means for selectively releasing the locking engagement by actuation by a thumb of the user substantially contemporaneously while lifting the accessory with the fingers of the same hand by application of upward pressure to said finger engaging surface of said gripping portion.

4. A support clip as defined in claim 3, wherein said locking means comprises a first portion attachable to the support member and a second portion attached to said support body, said first and second portions forming a snap-lock mechanism that locks said finger grip to the support member when mounted thereon, said releasing means comprising a release tab in proximity of said finger grip for selectively disengaging said snap-lock mechanism when actuated by a finger of a user, whereby said snap-lock mechanism may be disengaged substantially contemporaneously by a user just prior to lifting and separating said support body and object from the support member.

5. A support clip for detachably connecting an accessory to a tool belt in the form of an elongate flexible strap when the belt is worn by a user, the clip comprising a support body having a rear surface facing a tool belt when the clip is supported on the tool belt and a front surface facing in an opposing direction away from the tool belt when the clip is supported on the belt;

attaching means for attaching an accessory to said front surface of said support body;

a gripping portion extending upwardly and forwardly from said support body when the clip is supported on the belt, at least a portion of said gripping portion being situated above and defining a generally downwardly facing gripping surface spaced from said accessory to provide a space between said gripping portion and said accessory for a user to insert at least one finger between said gripping surface and the accessory;

and a snap-lock connector means for detachably connecting said support body and said accessory to and from the tool belt by placement of the user's fingers under said gripping surface by at least one finger of the user and lifting said gripping portion in a generally upward direction relative to the strap, said snap-lock connector means including a first portion for attachment to the tool belt and a second portion for attachment to said rear surface of said support body facing the tool belt and for selectively engaging and disengaging said first portion, and releasing means nestled within said finger-gripping portion positioned for actuation by a user's thumb for releasing said snap-lock portions from each other when actuated by the user's thumb simultaneously with a lifting motion of said finger-gripping portion by the user's finger or fingers positioned under said finger-gripping surface, whereby following release of said snap-lock portions from each other by actuation of said releasing means the user's remaining fingers can be used to substantially simultaneously lift said at least one receptacle and separate it from the tool belt.

6. A support clip as defined in claim 5, wherein said releasing means comprises a releasing tab or button accessible through an opening in said finger-gripping portion.

7. A support clip as defined in claim 5, wherein said downwardly-facing gripping surface of said finger-gripping portion is formed as a receiving recess below said finger-gripping portion that faces downwardly in the direction of said accessory for receiving the user's finger tips and for helping to prevent the user's fingers from inadvertently slipping out during lifting or transporting of said accessory.

8. A support clip as defined in claim 7, wherein said recess is dimensioned to receive at least four finger tips of the user exclusive of the thumb.

9. A support clip for detachably connecting an object to a support member, in which an object to be supported on a support member has a rear surface facing the support member when supported thereon, the clip comprising a finger grip extending forwardly from a rear surface of an object to be supported facing the support member when the clip is supported on the support member, at least a portion of said finger grip being situated above and defining a generally downwardly facing finger-gripping surface spaced from an attached accessory to provide a space for a user's fingers between said gripping surface and the object, said finger grip being secured to said support body at a proximal position relative to said support body and said finger gripping surface extending outwardly in cantilever fashion to a distal position relative to said support body to render said gripping surface accessible for positioning a user's fingers below said finger grip, said gripping surface having a width sufficient to be simultaneously engaged by a user's fingers so the engaged fingers can simultaneously apply a lifting force on said finger grip; and connecting means for detachably locking said attached object to and from the support member, said connecting means including an actuating member nestled within said finger grip and positioned to enable the fingers of a single hand to simultaneously engage both said gripping surface and said actuating member, whereby placement of a user's finger of one hand under said gripping surface while contemporaneously actuating said actuating member with the same hand permits lifting said finger grip in a generally upward direction relative to the support member, said gripping surface being situated above the object to be supported, whereby a center of gravity of an object and any contents therein is positioned below said finger grip and the object can be placed on, removed from the support member and transported by the user's fingers with maximum stability.

10. A support clip as defined in claim 9, wherein said connecting means comprises a snap-lock.

11. A support clip as defined in claim 9, wherein said downwardly-facing surface of said finger grip is formed as a receiving recess below said finger grip that faces downwardly in the direction of object for receiving the user's finger tips and for helping to prevent the user's fingers from inadvertently slipping out during lifting or transporting of said at least the object.

12. A support clip as defined in claim 11, wherein said recess is dimensioned to receive at least the four finger tips of the user's fingers exclusive of the thumb.

13. A support clip as defined in claim 9, further comprising locking means for selectively enabling and disabling said connecting means.

14. A support clip as defined in claim 9, wherein said actuating member is arranged for selectively releasing said object with the thumb of the user while the user's remaining fingers can be placed under said gripping surface.

15. A support clip for detachably connecting an accessory to a tool belt in the form of an elongate flexible strap when the belt is worn by a user, in which an accessory to be supported on the tool belt has a rear surface facing the tool belt when supported thereon, the clip comprising a gripping portion extending upwardly and forwardly from a rear surface of an accessory to be supported facing the tool belt when the clip is supported on the belt, at least a portion of said gripping portion being situated above and defining a generally downwardly facing gripping surface spaced from an attached accessory to provide a space for a user's fingers other than the thumb between said gripping surface and the accessory, said gripping surface having a width sufficient to be simultaneously engaged by a user's four fingers so they can all simultaneously apply a lifting force on said gripping portion;

connecting means for detachably connecting said gripping portion and attached accessory to and from the tool belt by placement of the user's fingers under said gripping surface by at least one finger of the user and lifting said gripping portion in a generally upward direction relative to the tool belt, said gripping surface being situated above the accessory to be supported, whereby a center of gravity of an accessory and any contents therein is positioned below said gripping portion and the accessory can be placed on, removed from the tool belt and transported by the user's fingers with maximum stability;

locking means for selectively enabling and disabling said connecting means; and releasing means for selectively releasing said locking means with the thumb of the user while the user's fingers are placed under said gripping surface, said releasing means comprises a releasing tab or button accessible through an opening in said finger-gripping portion.

* * * * *